United States Patent [19]

Hirano et al.

[11] Patent Number: 4,965,169

[45] Date of Patent: Oct. 23, 1990

[54] METHOD FOR FORMING A HIGH CONTRAST NEGATIVE IMAGE

[75] Inventors: Mitsunori Hirano; Masato Hirano; Morio Yagihara; Hisashi Okada, all of Kanagawa, Japan

[73] Assignee: Fuji Photo Film Co., Ltd., Kanagawa, Japan

[21] Appl. No.: 268,126

[22] Filed: Nov. 7, 1988

[30] Foreign Application Priority Data

Nov. 6, 1987 [JP] Japan ..... 62-280466

[51] Int. Cl.[5] ..... G03C 1/06; G03C 5/24

[52] U.S. Cl. ..... 430/264; 430/265; 430/267; 430/268; 430/379; 430/434; 430/438

[58] Field of Search ..... 430/265, 267, 268, 379, 430/264, 434, 464, 438

[56] References Cited

U.S. PATENT DOCUMENTS

| | | | |
|---|---|---|---|
| 4,429,036 | 1/1984 | Hirano et al. | 430/405 |
| 4,447,522 | 5/1984 | Hirano et al. | 430/405 |
| 4,478,928 | 10/1984 | Hess et al. | 430/217 |
| 4,657,847 | 4/1987 | Ikeda et al. | 430/523 |
| 4,746,601 | 5/1988 | Mihayashi et al. | 430/543 |
| 4,756,997 | 7/1988 | Marchesano et al. | 430/478 |
| 4,770,991 | 9/1988 | Kojima et al. | 430/611 |
| 4,777,118 | 10/1988 | Kitchin et al. | 430/264 |
| 4,788,132 | 11/1988 | Deguchi et al. | 430/505 |
| 4,839,258 | 6/1989 | Katoh | 430/264 |
| 4,851,321 | 7/1989 | Takagi et al. | 430/264 |

FOREIGN PATENT DOCUMENTS 133145 6/1988 Japan .

*Primary Examiner*—Paul R. Michl
*Assistant Examiner*—Patrick A. Doody
*Attorney, Agent, or Firm*—Sughrue, Mion, Zinn, Macpeak & Seas

[57] ABSTRACT

A method for forming a high contrast negative image comprising the steps of:

(a) imagewise exposing a silver halide photographic material comprising a support having thereon at least one light-sensitive silver halide emulsion layer, said emulsion layer or other hydrophilic colloid layer containing at least one hydrazine derivative; and (b) developing said exposed silver halide photographic material in an developer solution containing:

(1) a dihydroxybenzene developing agent;

(2) at least one auxiliary developing agent selected from a 1-phenyl-3-pyrazolidone auxiliary developing agent and a p-aminophenol auxiliary developing agent;

(3) at least 0.3 mol per liter of a sulfite; and (4) at least one compound represented by formula (I):

$$Y(\!(A)_n B)_m \qquad (I)$$

wherein Y represents a group capable of adsorbing to silver halide; A represents a divalent linking group; B represents an amino group, an ammonium group or a nitrogen containing heterocyclic group; m is 1, 2 or 3; and n is 0 or 1; to form a high contrast negative image.

21 Claims, No Drawings

METHOD FOR FORMING A HIGH CONTRAST NEGATIVE IMAGE

FIELD OF THE INVENTION

This invention concerns a method for developing silver halide photographic materials with high contrast and, more precisely, it concerns a method for forming high contrast negative type images which are suitable for photograving process making for printing purposes in the graphic arts.

BACKGROUND OF THE INVENTION

There is a need, in the field of graphic arts, for an image forming system which exhibits high contrast photographic characteristics to provide for the good reproduction of continuous tone images by means of a dot image and the good reproduction of line images.

Special developers, known as lith developers, have been used conventionally for this purpose. Lith developers contain hydroquinone as the developing agent and the sulfite which is used as a preservative is used in the form of an adduct with formaldehyde so as not to inhibit the infrectious development. The free sulfite ion concentration is maintained at a very low level. Consequently, the lith developers are very susceptible to aerial oxidation and suffer from a major disadvantage in that they cannot be stored for more than 3 days.

The methods in which hydrazine derivatives are used which have been disclosed in U.S. Pat. Nos. 4,224,401, 4,168,977, 4,166,742, 4,311,781, 4,272,606, 4,211,857 and 4,243,739 are methods in which high contrast photographic characteristics are achieved using a stable developer. Photographic characteristics of high speed and high contrast can be obtained with these methods, and it is also possible to add high concentrations of sulfite to the developer and so the stability of the developer with respect to aerial oxidation is very much greater than that of a lith developer.

However, when ultra-high contrast images are formed using these hydrazine compounds there is a problem with developer deterioration, in that the density falls and the gradation becomes softer as a result of changes in pH due to aerial oxidation of the developer, loss of developing agent and the accumulation of inhibitors.

More precisely, in high contrast developers which contain hydrazine compounds, $D_{max}$ is liable to change with variations in pH, and when used over long periods of time with high processed volume bromides and inhibitors accumulate during the processing of the sensitive material, development is inhibited by the effect of the materials which have dissolved out during processing, and this leads to a lowering of $D_{max}$.

As a result of various investigations aimed at countering these problems, accelerating agents such as the amino compounds disclosed in JP-A-60-140340 (the term "JP-A" as used herein signifies "unexamined published Japanese patent application"), the phosphonium salt compounds disclosed in JP-A-61-167939, the disulfide compounds disclosed in JP-A-61-198147, and the amino compounds which have an adsorbing group disclosed in JP-A-57-129434, Japanese Patent Application Nos. 61-271113 and 61-280998, have been added in an attempt to lessen the problem of the fall in $D_{max}$ by raising the value of $D_{max}$ in the early stages However, it has not been pOSsible tO prevent the fall in $D_{max}$ due to the passage of time or long term usage. Furthermore, problems exist with the formation of spots of developed silver known as black spotting (black pepper)

SUMMARY OF THE INVENTION

One object of the invention is to provide a method of forming stable, high contrast, negative images with which changes in photographic performance of the developer are unlikely to occur even after the passage of time or after long term use.

Another object of the invention is to provide a method for the formation of stable, high contrast, negative images in which a high $D_{max}$ can be obtained without the occurrence of black spotting.

The above and other objects and effects of this invention will be apparent from the following description.

These objects of this invention have been attained by a method for forming a high contrast negative image comprising the steps of:

(a) imagewise exposing a silver halide photographic material comprising a support having thereon at least one light-sensitive silver halide emulsion layer, the emulsion layer or other hydrophilic colloid layer containing at least one hydrazine derivative; and (b) developing the exposed silver halide photographic material in a developer solution containing:

(1) a dihydroxybenzene developing agent;

(2) at least one auxiliary developing agent selected from a 1-phenyl-3-pyrazolidone auxiliary developing agent and a p-aminophenol auxiliary developing agent;

(3) at least 0.3 mol per liter of a sulfite; and (4) at least one compound represented by formula (I):

$$Y(A)_n B)_m \qquad (I)$$

wherein Y represents a group Capable of adsorbing to silver halide; A represents a divalent linking group; B represents an amino group, an ammonium group or a nitrogen containing heterocyclic group; m is 1, 2 or 3; and n is 0 or 1; to form a high contrast negative image.

DETAILED DESCRIPTION OF THE INVENTION

Compounds represented by formula (I) is described in detail below.

Preferred examples of the group which promotes adsorption on silver halide represented by Y include a substituted or unsubstitited thioamido group, a substituted or unsubstitited mercapto group, substituted or unsubstitited groups which have disulfide bonds, and substituted or unsubstitited five-membered or six-membered nitrogen-containing heterocyclic groups.

Thioamido adsorption promoting groups which can be represented by Y are divalent groups which can be represented by the structure $$-\overset{\overset{\displaystyle S}{\|}}{C}\text{-amino-},$$

and this may be a part of a ring structure or a non-cyclic thioamido group. Useful thioamido adsorption promoting groups can be selected from among those disclosed, for example, in U.S. Pat. Nos. 4,030,925, 4,031,127, 4,080,207, 4,245,037, 4,255,511, 4,266,013 and 4,276,364 and in Research Disclosure, Volume 151, No. 15162 (November, 1976) and *Research Disclosure,* Volume 176, No. 17626 (December, 1978).

Specific examples of non-cyclic thioamido groups include a thioureido group, thiourethane group and dithiocarbamic acid ester group, and specific examples of cyclic thioamido groups include 4-thiazolin-2-thione, 4-imidazolin-2-thione, 2-thiohydantoin, rhodanine, thiobarbituric acid, tetrazolin-5-thione, 1,2,4-triazolin-3-thione, 1,3,4-thiadiazolin-2-thione, 1,3,4-oxadiazolin-2-thione, benzimidazolin-2-thione, benzoxazolin-2-thione and benzthiazolin-2-thione, and these may be further substituted.

Examples of the mercapto groups for Y include aliphatic mercapto groups, aromatic mercapto groups and heterocyclic mercapto groups (when there is a nitrogen atom adjacent to the carbon atom to which the —SH group is bonded, the situation is the same as that of the tautomerically related cyclic thioamido groups, and specific examples of these groups are the same as those given above). The aliphatic mercapto group represented by Y preferably has from 1 to 4 carbon atoms and examples thereof include an ethylmercapto group and a butylmercapto group. The aromatic or heterocyclic mercapto group represented by Y preferably has a 5-membered or 6-membered ring and examples thereof include a mercaptotetrazole group and a mercaptoimidazole group.

The five-membered or six-membered nitrogen-containing heterocyclic groups represented by Y include those which consist of a combination of nitrogen, oxygen, sulfur and carbon atoms. Of these, benzotriazoles, triazoles, tetrazoles, indazoles, benzimidazoles, imidazoles, benzothiazoles, thiazoles, benzoxazole,s oxazoles, thiadiazoles, oxadiazoles, triazines and azaindenes are preferred, and benzotriazoles, triazines and azaindenes are more preferred. These may be further substituted with suitable substituent groups.

Substituent groups for Y include a nitro group, a halogen atom (for example, chlorine, bromine), a mercapto group, a cyano group, substituted or unsubstituted alkyl groups (for example, methyl, ethyl, propyl, t-butyl, cyanoethyl, methoxyethyl, methylthioethyl), substituted or unsubstituted aryl groups (for example, phenyl, 4-methanesulfonamidophenyl, 4-methylphenyl, 3,4-dichlorophenyl, naphthyl), substituted or unsubstituted alkenyl groups (for example, allyl), substituted or unsubstituted aralkyl groups (for example, benzyl, 4-methylbenzyl, phenethyl), alkoxy groups (for example, methoxy, ethoxy), aryloxy groups (for example, phenoxy, 4-methoxyphenoxy), alkylthio groups (for example, methylthio group, ethylthio group, ethoxyethylthio), arylthio groups (for example, phenylthio), sulfonyl groups (for example, methanesulfonyl, ethanesulfonyl, p-toluenesulfonyl), carbamoyl groups (for example, unsubstituted carbamoyl, methylcarbamoyl group, phenylcarbamoyl), sulfamoyl groups (for example, unsubstituted sulfamoyl, methylsulfamoyl, phenylsulfamoyl), carbonamido groups (for example, acetamido, benzamido), sulfonamido groups (for example, methanesulfonamido, benzenesulfonamido, p-toluenesulfonamido), acyloxy groups (for example, acetyloxy, benzoyloxy), sulfonyloxy groups (for example, methanesulfonyloxy), ureido groups (for example, unsubstituted ureido, methylureido, ethylureido, phenylureido), thioureido groups (for example, unsubstituted thioureido, methylthioureido), acyl groups (for example, acetyl, benzoyl), heterocyclic groups (for example, 1-morpholino, 1-piperidino, 2-pyridyl, 4-pyridyl, 2-thienyl, 1-pyrazolyl, 1-imidazolyl, 2-tetrahydrofuryl, tetrahydrothienyl), oxycarbonyl groups (for example, methoxycarbonyl, phenoxycarbonyl), oxycarbonylarmino groups (for example, methoxycarbonylamino, phenoxycarbonylamino, 2-ethylhexyloxycarbonylamino), amino groups (for example, unsubstituted amino, dimethylamino, methoxyethylamino, anilino), carboxylic acid or salts thereof, sulfonic acid or salts thereof, and a hydroxyl group, and these groups may be further substituted.

The divalent linking groups represented by A are atoms, or groups of atoms, and include at least one carbon atom, nitrogen atom, sulfur atom or oxygen atom. Actual examples of these groups include alkylene groups, alkenylene groups, alkynylene groups, arylene groups, —O—, —S—,

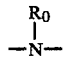

(wherein $R_0$ represents a hydrogen atom, an alkyl group or an aryl group), —CO—, —$SO_2$— (which may have substituent groups) either individually or in combinations.

Specific examples include the following groups:

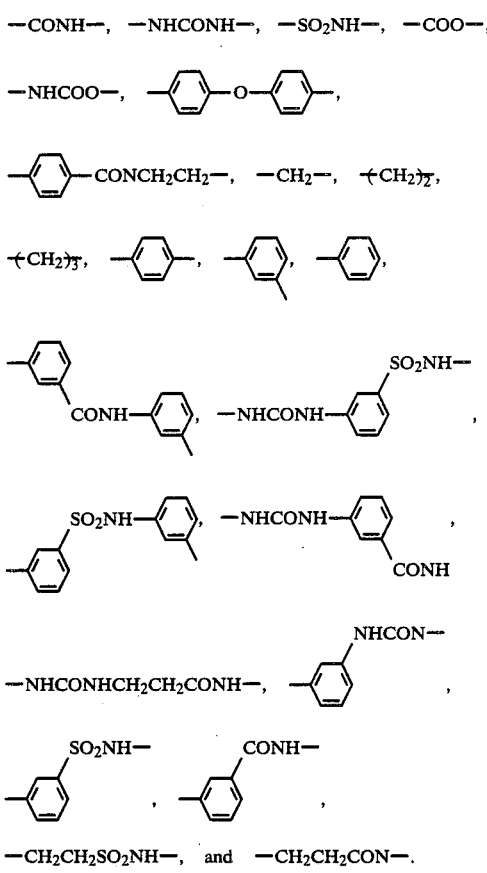

These groups may be further substituted with suitable substituent groups of which examples include those described as substituent group for Y.

The amino group B can be represented by formula (II).

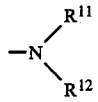

(II)

In formula (II), $R^{11}$ and $R^{12}$ which may be the same or different, each represents hydrogen, a substituted or unsubstituted alkyl group, a substituted or unsubstituted alkenyl group or a substituted or unsubstituted aralkyl group which preferably have from 1 to 30 carbon atoms, more preferably have from 1 to 10 carbon atoms. These groups may have a linear chain (for example, methyl group, ethyl group, n-propyl group, n-butyl group, n-octyl group, allyl group, 3-butenyl group, benzyl group, 1-naphthylmethyl group), a branched chain (for example, iso-propyl group, t-octyl group) or a cyclic form (for example cyclohexyl group).

Furthermore, $F^{11}$ and $R^{12}$ may be linked to form a ring and they may be cyclized in such a way as to form a saturated heterocyclic which contain within it one or more hetero atoms(s) (for example oxygen atom(s), sulfur atom(s), nitrogen atom(s)) forming, for example, a pyrrolidyl group, a piperidyl group or a morpholino group. Furthermore, examples of substituent groups for $R^{11}$ and $R^{12}$ include a carboxyl group, a sulfo group, a cyano group, halogen atoms (for example, fluorine, chlorine, bromine), a hydroxyl group, alkoxycarboxyl groups which have not more than 20 carbon atoms (for example, methoxycarbonyl, ethoxycarbonyl, benzyloxycarbonyl), aryloxycarbonyl groups which have not more than 20 carbon atoms (for example, phenoxycarbonyl), alkoxy groups which have not more than 20 carbon atoms (for example, methoxy, ethoxy, benzyloxy, phenethyloxy), single ring aryloxy groups which have not more than 20 carbon atoms (for example, phenoxy, p-tolyloxy), acyloxy groups which have not more than 20 carbon atoms (for example, acetyloxy, propionyloxy), acyl groups which have not more than 20 carbon atoms (for example, acetyl, propionyl, benzoyl, mesyl), carbamoyl groups (for example, carbamoyl, N,N-dimethylcarbamoyl, morpholinocarbamoyl, piperidino carbonyl), sulfamoyl groups (for example sulfamoyl, N,N-dimethylsulfamoyl, morpholinosulfonyl, piperidinosulfonyl), acylamino groups which have not more than 20 carbon atoms (for example acetylamino, propionylamino, benzoylamino, mesylamino), sulfonamido groups (for example, ethylsulfonamido, p-toluenesulfonamido), carbonamido groups which have not more than 20 carbon atoms (for example, methylcarbonamido, phenylcarbonamido), ureido groups which have not more than 20 carbon atoms (for example, methylureido, phenylureido) and amino groups (which may be the same as those represented by formula (II)).

The ammonium salts of B can be represented by formula (III)

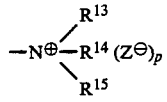

(III)

In formula (III), $R^{13}$, $R^{14}$ and $R^{15}$, which may be the same or different, each has the same definition as $R^{11}$ in formula (II); $Z^{\ominus}$ represents an anion necessary for chage balance, for example, a halide ion (for example, $Cl^-$, $Br^-$, $I^-$), a sulfonate ion (for example trifluoromethanesulfonate, p-toluenesulfonate, benzenesulfonate, p-chlrobenzenesulfonate), a sulfate ion (for example, ethylsulfate, methylsulfate), a perchlorate ion, or a tetrafluoroborate ion; and p is 0 or 1, being 0 when the compound forms an intramolecular salt.

The nitrogen containing heterocyclic group of B are five-membered or six-membered rings which contain at least one nitrogen atom, and these rings may have substituent groups such as those described for Y, and they may be condensed with other rings. Examples of nitrogen containing heterocyclic group include an imidazolyl group, a pyridyl group and a thiazolyl group.

Preferred compounds represented by formula (I) are represented by formula (IV) or formula (V):

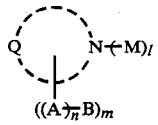

(IV)

In formula (IV), A, B, m and n each is defined as in formula (I), and Q represents an atomic group required for forming a five-membered or six-membered heterocyclic ring containing atoms selected from carbon, nitrogen, oxygen, and sulfur, which may be condensed with a carbon aromatic ring or a heterocyclic aromatic ring; l is 0 or 1;

M represents a hydrogen atom, an alkali metal (for example, sodium, potassium), an ammonium group (for example, trimethylammonium, dimethylbenzylammonium), or a group which can be replaced by a hydrogen atom or an alkali metal under alkaline conditions (for example, an acetyl group, cyanoethyl group, methanesulfonylethyl group).

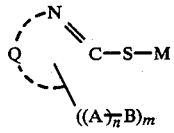

(V)

In formula (V), A, B, m, N and Q each has the same definition as in formula (IV).

Of the compounds represented by formula (I), those represented by formulae (VI), (VII), (VIII), (IX), (X) and (XI) are more preferred.

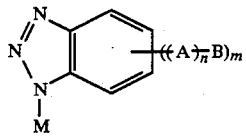

(VI)

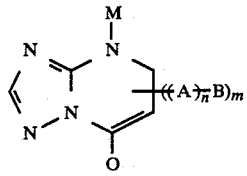

(VII)

-continued

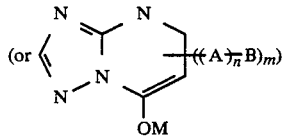

(VIII)

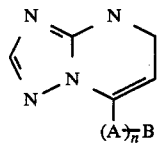

(IX)

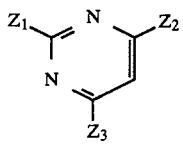

(X)

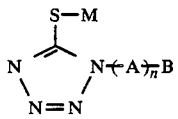

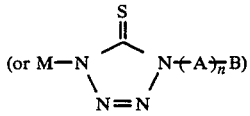

(XI)

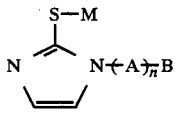

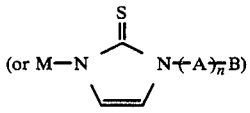

The plural formulae in formula (VII), formula (X) and formula (XI) are tautomers, respectively.

In formulae (VI) to (XI), A, B, M, n and m have the same definition as in formulae (IV) and (V). $Z_1$, $Z_2$ and $Z_3$, which may be the same or different, each represents $-((A)_n-B)_m$ as defined in formula (I), a halogen atom, an alkoxy group having not more than 20 carbon atoms (for example, methoxy, a hydroxyl group, a hydroxyamono group or a substituted or unsubstituted amono group, provided that at leaSt one of $Z_1$, $Z_2$ and $Z_3$ represents a group $-((A)_n-B)_m$ as defined in formula (I). Examples of substituents for the group represented by $Z_1$, $Z_2$ or $Z_3$ include those for $R^{11}$ and $R^{12}$ in formula (II).

Illustrative compounds represented by formula (I) are indicated below, but the invention is not to be construed as being limited by these examples.

1.

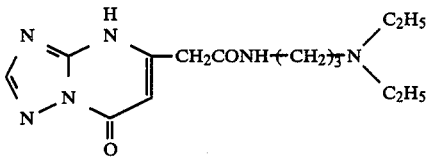

-continued

2.

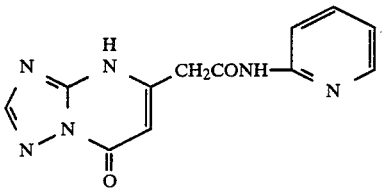

3.

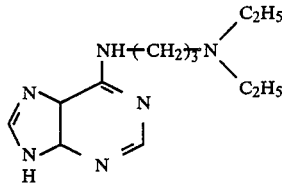

4.

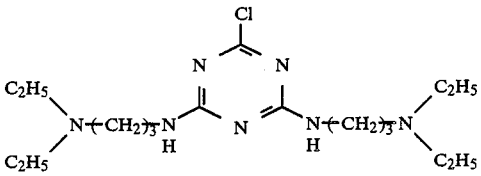

5.

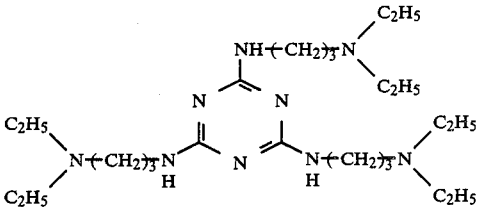

6.

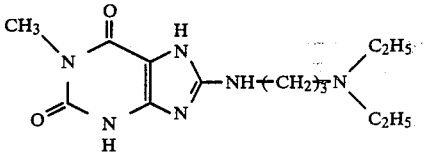

7.

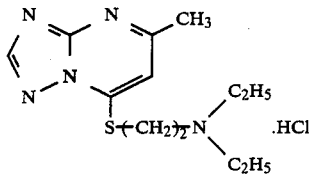

8.

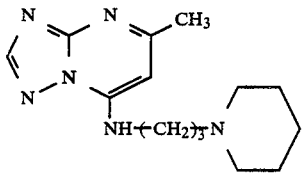

9.

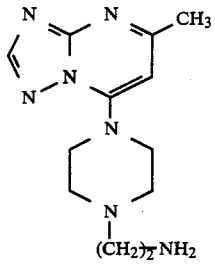

-continued
10.
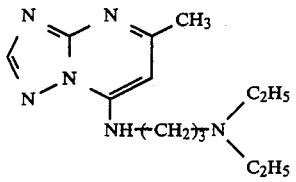
11.
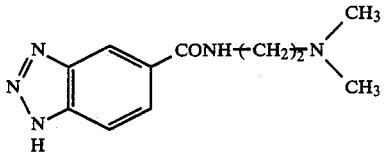
12.
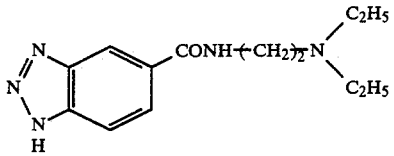
13.
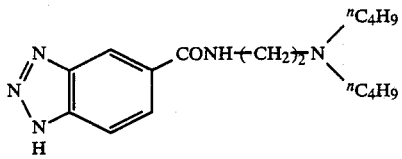
14.
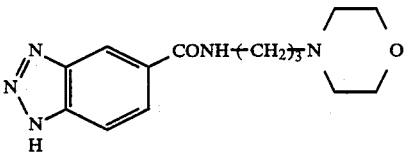
15.
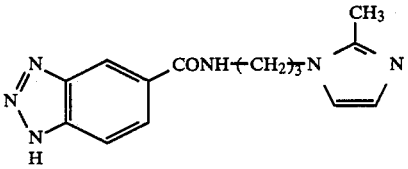
16.
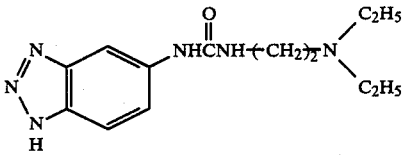
17.
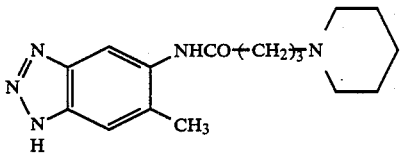
18.
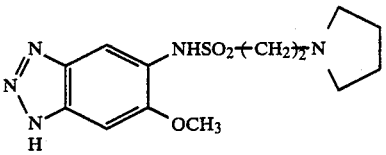
-continued
19.
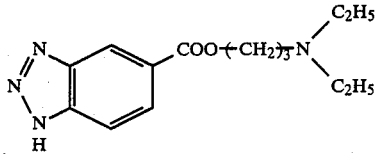
20.
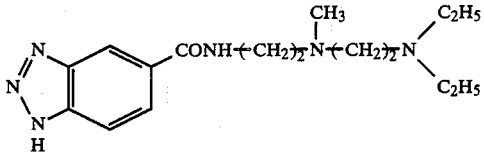
21.
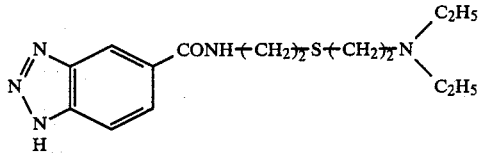
22.
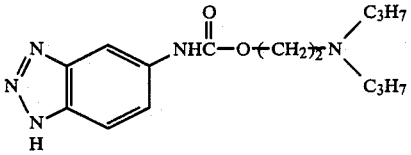
23.
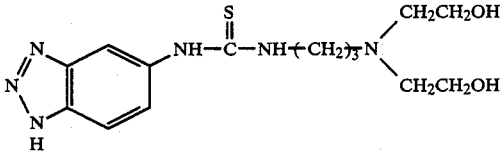
24.
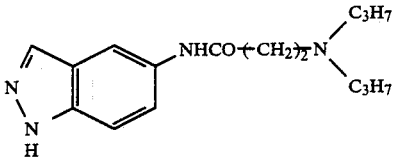
25.
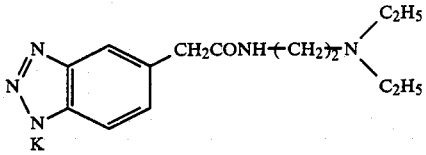
26.
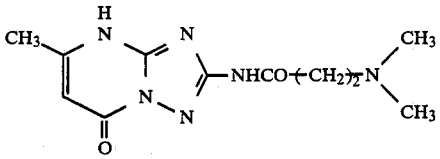
27.
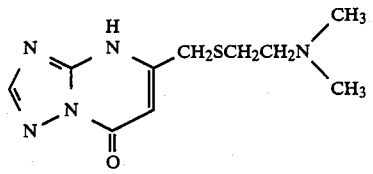

-continued
28.
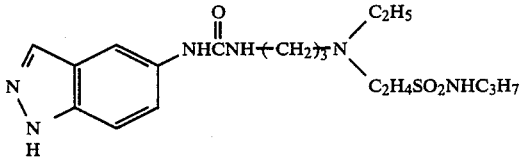
29.
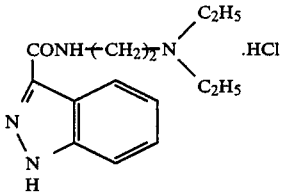
30.
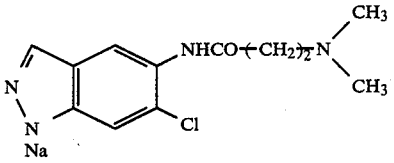
31.
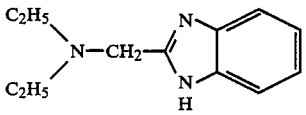
32.
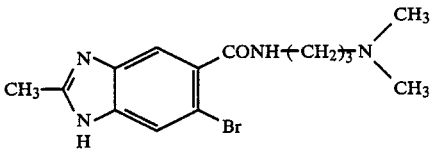
33.
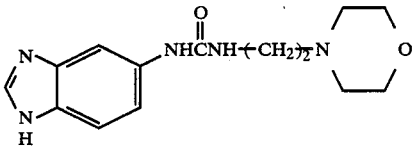
34.
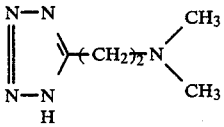
35.
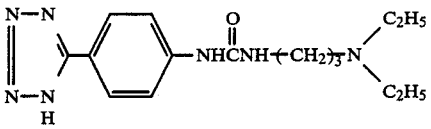
36.
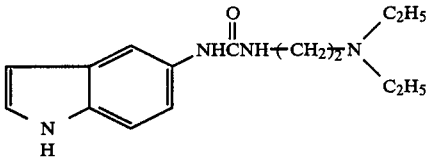
37.
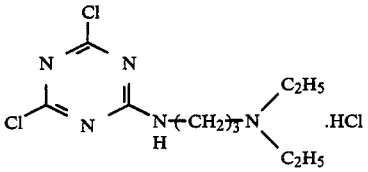
-continued
38.
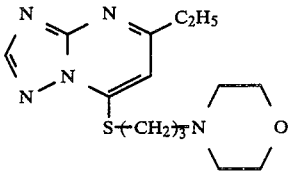
39.
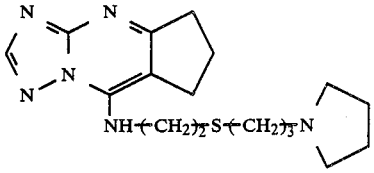
40.
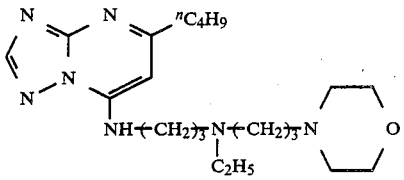
41.
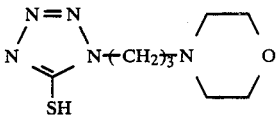
42.
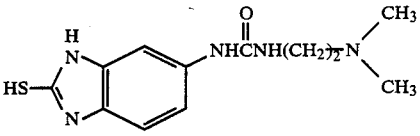
43.
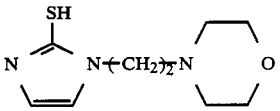
44.
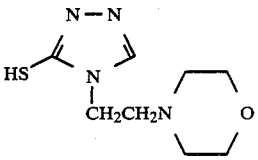
45.
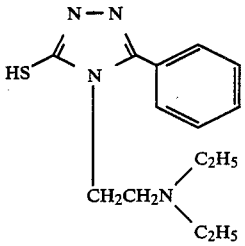
46.
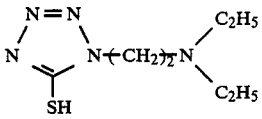

-continued
47.
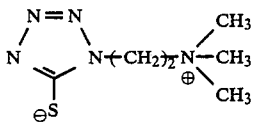
48.
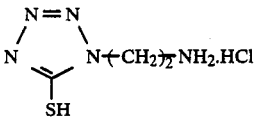
49.
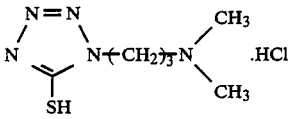
50.
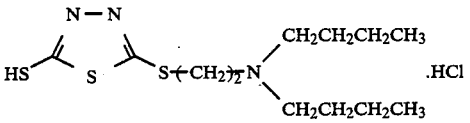
51.
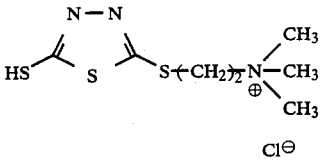
52.
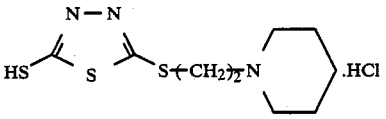
53.
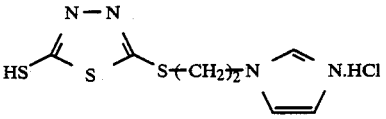
54.
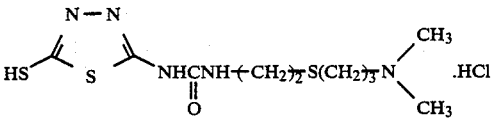
55.
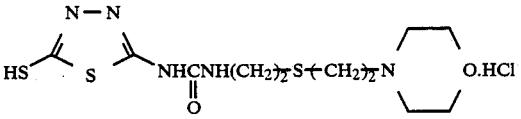
56.
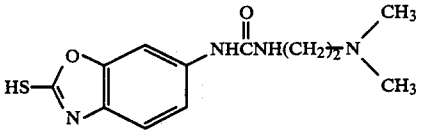
57.
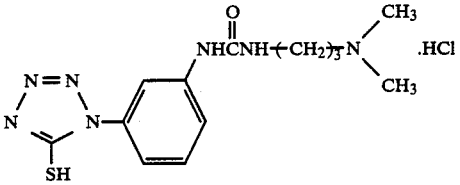
-continued
58.
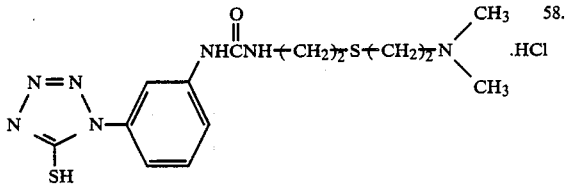
59.
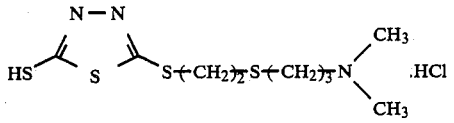
60.
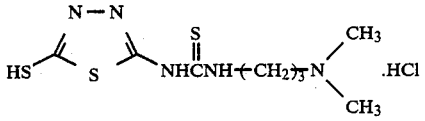
61.
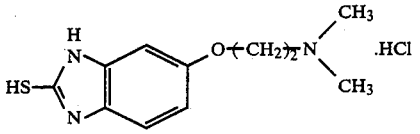
62.
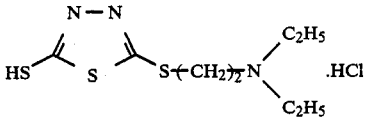
63.
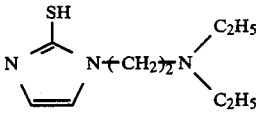
64.
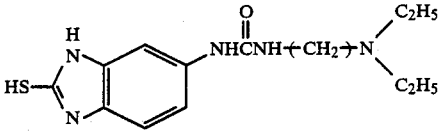
65.
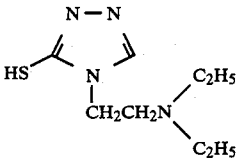
66.
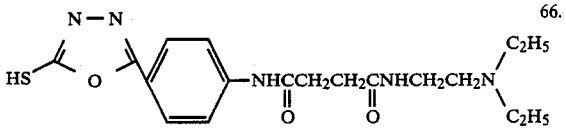
67.
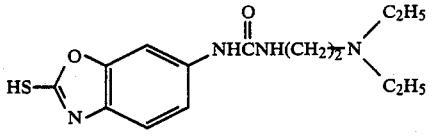
68.
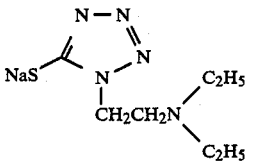

-continued

69. 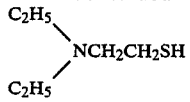

70. 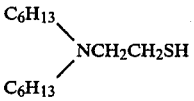

71. 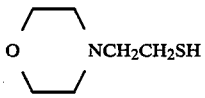

72. $(HOCH_2CH_2)_2NCH_2CH_2SH$

73. 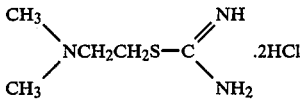

The compounds represented by formula (I) which are used in this invention can be prepared using the methods disclosed in *Berichte der Deutschen Chemischen Gesellschaft,* 28, 77 (1895), JP-A-50-37436 and JP-A-51-3231, U.S. Pat. Nos. 3,295,976 and 3,376,310, *Berichte der Deutschen Chemischen Gesellschaft,* 22, 568 (1889), *Berichte der Deutschen Chemischen Gesellschaft,* 29, 2483 (1896), *J. Chem. Soc.,* 1932, 1806, *J. Am. Chem. Soc.,* 71, 4000 (1949), U.S. Pat. Nos. 2,585,388 and 2,541,924, *Organic Synthesis* IV, 569 (1963), *J. Am. Chem. Soc.,* 45, 2390 (1923), *Chemische Berichte,* 9, 465 (1876), JP-B-40-28496, JP-A-50-89034, U.S. Pat. Nos. 3,106,467, 3,420,670, 2,271,229, 3,137,578, 3,148,066, 3,511,663, 3,060,028, 3,271,154, 3,251,691, 3,598,599 and 3,148,066, JP-B-43-4135, U.S. Pat. Nos. 3,615,616, 3,420,664, 3,071,465, 2,444,605, 2,444,606, 2,444,607 and 2,935,404, JP-A-57-202531, JP-A-57-167023, JP-A-57-164735, JP-A-60-80839, JP-A-58-152235, JP-A-57-14836, JP-A-59-162546, JP-A-60-130731, JP-A-60-138548, JP-A-58-8352A, JP-A-58-159529, JP-A-59-159162, JP-A-60-217358 and JP-A-61-80238, and in JP-B-60-29390, JP-B-60-29391, JP-B-60-133061 and JP-B-61-1431 and in accordance with the examples of synthesis in Japanese Patent Application Nos. 61-271113 and 61-280998.

The optimum amounts of the compounds represented by formula (I) vary according to type of compound, but the amount used is generally within the range from $1\times10^{-2}$ to $1\times10^{-5}$ mol per liter, and preferably within the range from $5\times10^{-3}$ to $1\times10^{-4}$ mol per liter of developer solution.

The hydrazine derivatives which have sulfinyl groups disclosed in U.S. Pat. No. 4,478,928 and the compounds represented by formula (XII) below can be used as the hydrazine derivatives which are used in the invention.

$$R_1\text{—NHNH—CHO} \qquad \text{(XII)}$$

In formula (XII), $R_1$ represents an aliphatic group or an aromatic group.

The preferred aliphatic groups represented by $R_1$ in formula (XII) are those which have from 1 to 30 carbon atoms, and the linear chain, branched chain and cyclic alkyl groups which have from 1 to 20 carbon atoms are especially desirable. Here, the branched alkyl groups may be cyclized to form a saturated heterocyclic ring which contains within it one or more hetero atom(s). Furthermore, the alkyl groups may have substituent groups, such as aryl groups, alkoxy groups, sulfoxy groups, sulfonamido groups, or carbonamido groups.

Examples of these groups include a t-butyl group, n-octyl group, t-octyl group, cyclohexyl group, pyrrolidyl group, imidazolyl group, tetrahydrofuryl group, and morpholino group.

The aromatic groups represented by $R_1$ in formula (XII) include single or double ring aryl groups or unsaturated heterocyclic groups. The unsaturated heterocyclic groups may be condensed with a single or double ringed aryl group to form a heteroaryl group. Examples thereof include a benzene ring, naphthalene ring, pyridine ring, pyrimidine ring, imidazole ring, prrolazole ring, quinoline ring, isoquinoline ring, benzimidazole ring, thiazole ring, benzothiazole ring and but, of these, those which contain a benzene ring are preferred.

Aryl groups are the most preferred groups for $R_1$.

The aryl or aromatic $R_1$ groups may have substituent groups.

Typical substituent groups include linear chain, branched or cyclic alkyl groups (preferably those which have from 1 to 20 carbon atoms), aralkyl groups (preferably one or two ring groups of which the alkyl portion has from 1 to 3 carbon atoms), alkoxy groups (preferably those which have from 1 to 20 carbon atoms), substituted amino groups (preferably amino groups which are substituted with alkyl groups which have from 1 to 20 carbon atoms), acylamino groups (preferably those which have from 2 to 30 carbon atoms), sulfonamido groups (preferably those which have from 1 to 30 carbon atoms), and ureido groups (preferably those which have from 1 to 30 carbon atoms).

$R_1$ in formula (XII) may also incorporate a ballast group of the type generally used in immobile photographically useful additives such as couplers. Ballast groups are groups which are comparatively inactive photographically and which have at least 8 carbon atoms, and they can be selected for example from among alkyl groups, alkoxy groups, phenyl groups, alkylphenyl groups, phenoxy groups, and alkylphenoxy groups.

$R_1$ in formula (XII) may also incorporate groups which can be strongly adsorbed on the surfaces of silver halide grains. Such adsorption groups include thiourea groups, heterocyclic thioamido groups, mercapto heterocyclic groups, triazole groups and the groups disclosed in U.S. Pat. No. 4,385,108.

The compounds represented by formula (XII) can be synthesized using the methods disclosed in JP-A-53-20912, JP-A-53-20922, JP-A-53-66732 and JP-A-53-20318.

One preferred embodiment of the photographic material of this invention comprises a support having provided thereon one or two silver halide emulsion layer(s) and one or two protective layer(s) on the emulsion layer, but this invention is not construed as being limited thereto.

In this invention, the compounds represented by the formula (XII) are included in a photographic material, and they are preferably included in a silver halide emulsion layer, but they can be included in other non-photosensitive hydrophilic colloid layers (for example protective layers, intermediate layers, filter layers and anti-halation layers). In practical terms, the compounds which are water soluble may be added to the hydrophilic colloid solution in the form of aqueous solutions, and those which are sparingly soluble in water can be added as solutions in organic solvents which are miscible with water, such as alcohols, esters, and ketones. The addition to a hydrophilic colloid solution can be made at any time during the interval from the start of chemical ripening to before coating, but the addition is preferably made after the completion of chemical ripening but prior to coating. The addition is best made to the coating liquid which is to be used for coating.

The amounts of the compounds represented by formula (XII) of this invention included are preferably selected in connection with the grain size of silver halide emulsion, the halogen composition, the method and extent of chemical sensitization, the relationship between the layer which contains the compound and the silver halide emulsion layer, and the type of anti-fogging compound, and the test methods for making such a selection are well known to those skilled in the art. Generally, an amount within the range from $1\times10^{-6}$ mol to $1\times10^{-1}$ mol per mol of silver halide is preferred, and the inclusion of an amount within the range from $1\times10^{-5}$ to $4\times10^{-2}$ mol per mol of silver halide is most preferred.

Specific examples of compounds which can be represented by formula (XII) are indicated below, but the invention is not to be construed as being limited to these compounds.

H-1

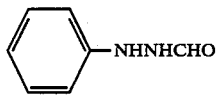

H-2

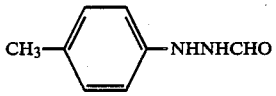

H-3

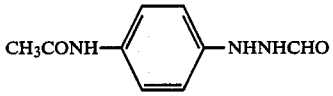

H-4

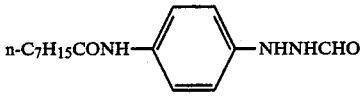

H-5

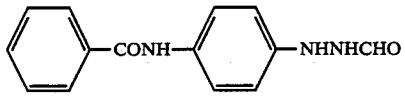

H-6

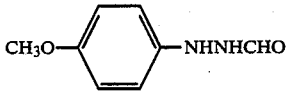

H-7

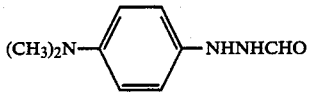

H-8

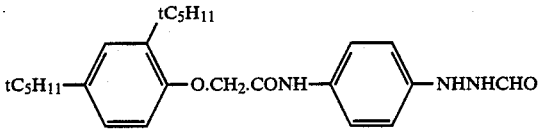

H-9

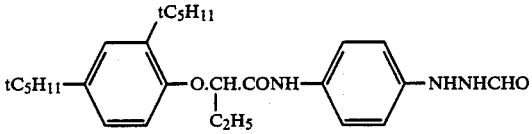

H-10

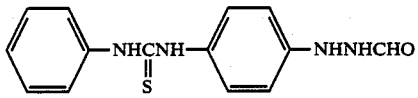

-continued
H-11
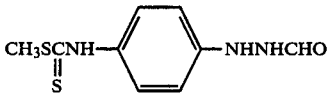
H-12
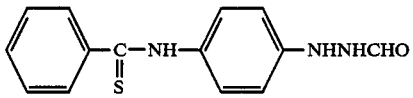
H-13
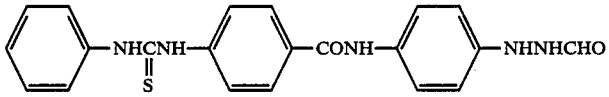
H-14
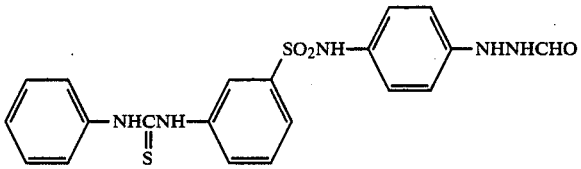
H-15
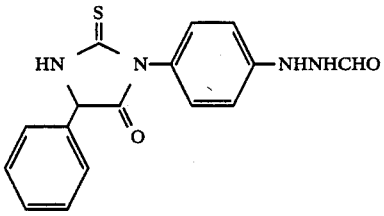
H-16
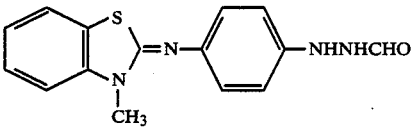
H-17
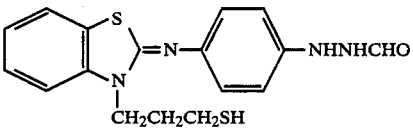
H-18
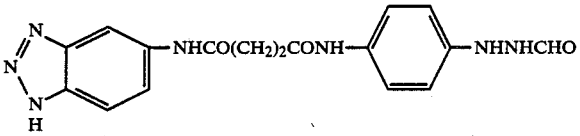
H-19
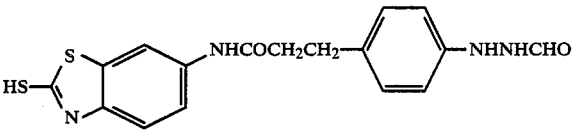
H-20
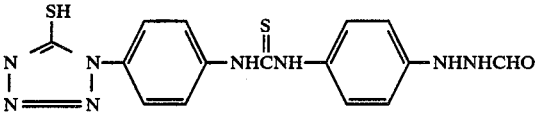

-continued
H-21
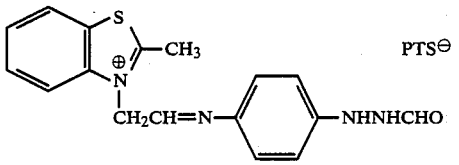
H-22
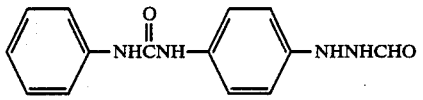
H-23
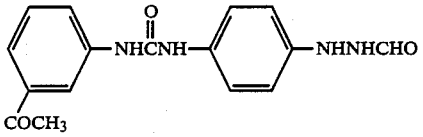
H-24
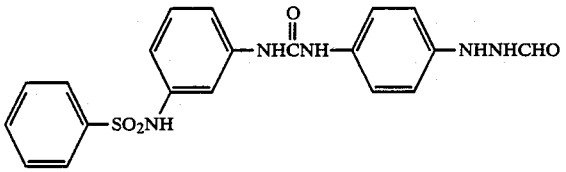
H-25
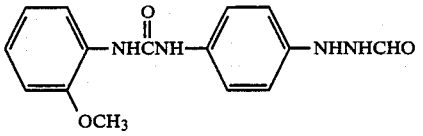
H-26
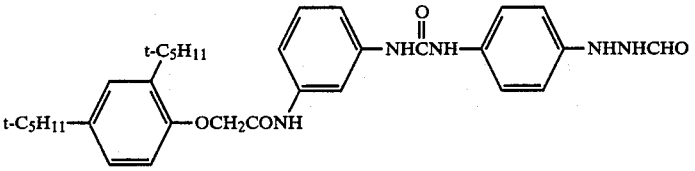
H-27
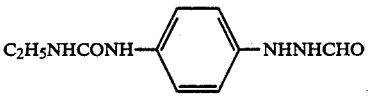
H-28
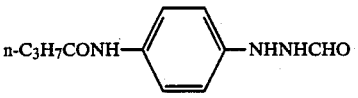
H-29
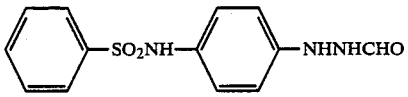
H-30
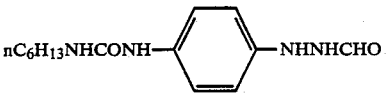
H-31
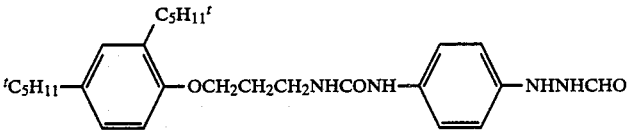

-continued

H-32

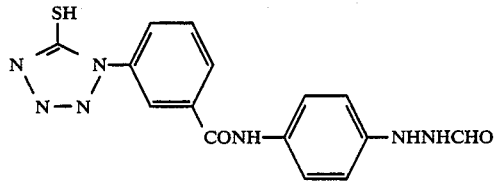

H-33

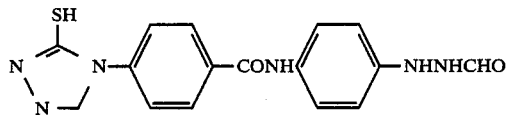

H-34

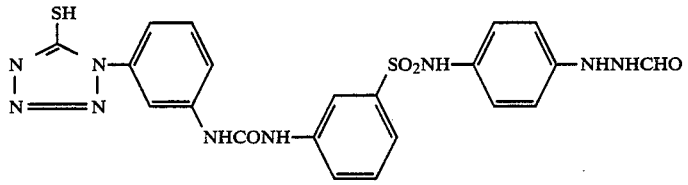

H-35

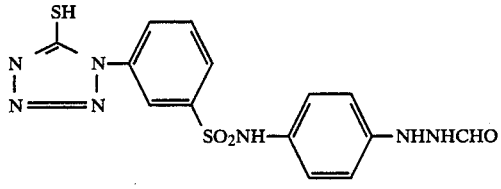

H-36

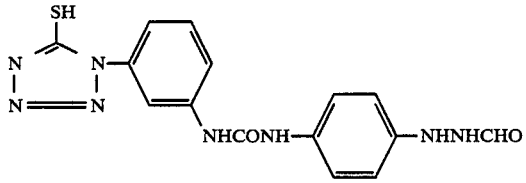

H-37

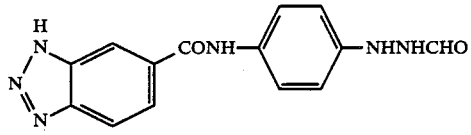

The compounds indicated below and disclosed in U.S. Pat. No. 4,478,928 can also be used as hydrazine derivatives.

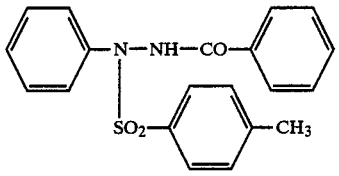

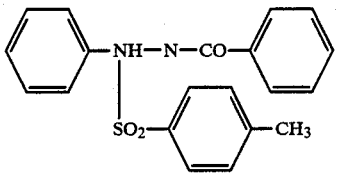

-continued

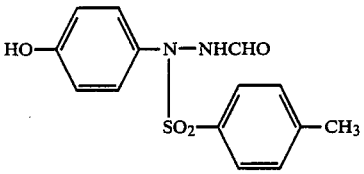

The use of a dihydroxybenzene based developing agent as the main developing agent and at least one of a p-aminophenyl based developing agent and a 3-pyrazolidone based developing agent as an auxiliary developing agent is required in the method of image formation of this invention.

The hydroxybenzene based developing agents which can be used in the invention include hydroquinone, chlorohydroquinone, bromohydroquinone, isopropylhydroquinone, methylhydroquinone, 2,3-dichlorohydroquinone, 2,3-dibromohydroquinone and 2,5-dimethylhydroquinone and, of these, the use of hydroquinone is preferred.

1-Phenyl-3-pyrazolidone or derivatives thereof can be used as an auxiliary developing agent, and examples include 1-phenyl-4,4-dimethyl-3-pyrazolidone, 1-phenyl-4-methyl-4-hydroxmethyl-3 pyrazolidone, 1-phenyl-4,4-dihydroxymethyl-3-pyrazolidone, 1-phenyl- 5-methyl-3-pyrazolidone, 1-p-aminophenyl-4,4-dimethyl-3pyrazolidone, and 1-p-tolyl-4,4-dimethyl-3-pyrazolidone.

N-methyl-p-aminophenol, p-aminophenyl, N-(β-hydroxyethyl)-p-aminophenol, N-(4-hydroxyphenyl)glycine, 2 methyl-p-aminophenol, and p-benzylaminophenol can be used as the p-aminophenol based auxiliary developing agent, but of these the use of N-methyl p-aminophenol is preferred.

Generally, the use of an amount of the dihydroxybenzene based developing agent of from 0.05 to 0.8 mol per liter of the developer solution is preferred. Furthermore, the use of from 0.05 to 0.5 mol per liter of the 1-phenyl-3-pyrazolidone auxiliary developing agent, and not more than 0.06 mol per liter of the p-aminophenyl auxiliary developing agent, is preferred.

Sodium sulfite, potassium sulfite, lithium sulfite, sodium bisulfite, potassium metabisulfite, formaldehyde/-sodium sulfite can be employed as a sulfite preservative in this invention. The amount of sulfite used is generally at least 0.3 mol/liter of developer solution, but problems arise with precipitation in the developer and with liquid contamination if too much is used and so an upper limit of 1.2 mol/liter is desirable.

Tertiary amine compounds, especially the compounds disclosed in U.S. Pat. No. 4,269,929, can be included as development accelerators in the developers of this invention.

The pH buffers disclosed in JP-A-60-93433 can be used as well as pH buffers such as boric acid, borax, silicates, sodium triphosphate and potassium triphosphate in the developers of this invention. These are preferably used at a concentration of at least 0.3 mol/-liter.

Furthermore, development inhibitors such as potassium bromide and potassium iodide; organic solvents such as ethylene glycol, diethylene glycol, triethylene glycol, dimethylformamido, methylcellosolve, hexylene glycol, ethanol and methanol; anti-foggants and anti-color spotting (black pepper) agents, such as the indazole based compounds (e.g., 5-nitroindazole), sodium 2-mercaptobenzimidazol-5-sulfonate and benzthiazole based compounds (e.g., 5-methylbenztriazole) may be included, and when compounds such as 5-nitroindazole are used in particular, they can be dissolved beforehand in a part separate from that which contains the dihydroxybenzene based developing agents and the sulfite preservative, the two parts generally being mixed together and water added at the time of use. Moreover, when the part in which the 5-nitroindazole is dissolved is made alkaline it becomes yellow, and this is useful for handling.

Moreover, toners, surfactants, hard water softeners, film hardening agents may be included, as required.

The pH of the developer solution is preferably high at over 9, and a pH in the range from 9.5 to 12.3 is especially desirable.

Conventional compositions can be used as fixers. As well as thiosulfates and thiocyanates, use can also be made of the organic sulfur compounds which are known to be effective as fixing agents. Water soluble aluminum salts, for example aluminum sulfate, alum, can be included in the fixer bath as film hardening agents. The water soluble aluminum compound is normally used at a concentration of from 0 to 30 grams of aluminum per liter. Ethylenediamine tetra-acetic acid Fe(III) complex salts can also be used as oxidizing agents.

The processing temperature is normally selected within the range from 18° C. to 50° C., but temperatures lower than 18° C. and in excess of 50° C. can be used.

In the method of this invention, a photographic material which has been developed and fixed is generally washed with water and then dried. The washing step is conducted to substantially completely remove the silver halide dissolved by the fixing step, and is preferably conducted at about 20 to 50° C. for 10 seconds to 3 minutes. The drying time can change depending on the circumambient conditions and is generally about 5 to 210 seconds.

The high contrast negative images which can be obtained by the method accoding to this invention preferably have an average gamma value $\overline{G}(0.3-3.0)$ of from 8.0 to 30.0, and more preferably from 10.0 to 25.0. The term "$\overline{G}(0.3-3.0)$" as used herein means an average gamma value within the density range of from 0.3 to 3.0.

No particular limitation is imposed on the halogen composition of the silver halide which is used in the invention and compositions such as silver chloride, silver chlorobromide silver iodobromide, silver bromide, and silver iodochlorobromide can be used.

The silver halide grains in the photographic emulsions used in the invention may have a comparatively wide grain size distribution, but narrow grain size distributions are preferred, and emulsions in which the size of the grains which account for 90% of the whole in terms of the weight or number of silver halide grains is within ±40% of the average grain size are especially preferred (emulsions of this type are generally known as monodisperse emulsions.)

The silver halide grains used in the invention are preferably fine grains (for example not larger than 0.7 μm), and grains of not more than 0.4 μm are especially desirable.

The silver halide grains in the photographic emulsion may have a regular crystalline form, such as cubic, or octahydral form, an irregular form, such as spherical or tabular form, or they may have a complex form which incorporates these crystalline forms.

The silver halide grains may be such that the interior part and the surface layer consist of a uniform phase, or the interior apt and the surface layer may consist of different phases.

Mixtures of two or more silver halide emulsions which have been prepared separately can also be used.

Cadmium salts, sulfities, lead salts, thallium salts, iridium salts or complex salts thereof, rhodium salts or complex salts thereof, may also be present in the processes in which the silver halide grains used in the invention are being formed or physically ripened.

The silver halide emulsions can be used as primitive emulsions which have not been chemically sensitized, but they may be chemically sensitized. The methods described by H. Frieser in *Die Grund Lagen der Photogrphischen Prozesse mit Silverhalogeniden* Akademische Verlagsgesselschaft (1968) can be used for chemical sensitization.

Thus, the sulfur sensitization method in which compounds which contain sulfur which can react with active gelatin or silver (for example thiosulfates, thioureas, mercapto compounds, rhodanines) are used, reduction sensitization methods in which reducing substances (for example stannous salts, amines, hydrazine derivatives, formamidine sulfinic acid, silane compounds) are used, and noble metal sensitization methods in which noble metal compounds (for example complex salts of metals such as platinum, iridium palladium of group VIII of the periodic table, as well as gold) are used, can be used for this purpose.

Gelatin is useful as a binder or protective colloid in the emulsion layers and intermediate layers of the photosensitive materials of this invention, but other hydrophilic colloids can be used for this purpose.

For example, use can be made of gelatin derivatives, graft polymers of gelatin and other polymers, proteins such as albumin, and casein; cellulose derivatives such as hydroxyethylcellulose, carboxymethylcellulose, cellulose sulfate esters; sugar derivatives such as sodium alginate; and many types of synthetic hydrophilic polymeric materials, such as poly(vinyl alcohol), partially acetalated poly(vinyl alcohol), poly(N-vinylpyrrolidone), poly(acrylic acid), poly(methacrylic acid), polyacrylamide, polyvinylimidazole, polyvinylpyrazole homopolymers or copolymers thereof.

Lime treated gelatin, acid treated gelatin or enzyme treated gelatin as described on page 30 of *Bull. Soc. Sci. Phot. Japan,* No. 16, page 30 (1966) can be used as the gelatin, and the hydrolysis products or enzyme degradation products of gelatin can also be used as the gelatin.

The photographic emulsions used in the invention may be spectrally sensitized with methine dyes or other dyes. The dyes which may be used for this purpose include cyanine dyes, merocyanine dyes, complex cyanine dyes, complex merocyanine dyes, holopolar cyanine dyes, hemicyanine dyes, styryl dyes and hemioxonol dyes. The dyes which are classified as cyanine dyes, merocyanine dyes and complex merocyanine dyes are especialy useful. These dyes can be used in combinations so as to provide a strong color sensitizing effect.

Substances which are dyes but which do not themselves have a spectrally sensitizing effect or substances which have essentially no absorption in the visible region but which exhibit strong color sensitizing properties together with the sensitizing dyes can be included in the emulsion. For example, the aminostilbene compounds which have been substituted with nitrogen containing heterocyclic groups (for example those disclosed in U.S. Pat. Nos. 2,933,930 and 3,635,721), aromatic organic acid/formaldehyde condensates (for example those disclosed in U.S. Pat. No. 3,743,510), cadmium salts, and azaindene compounds can be included for this purpose. The combinations disclosed in U.S. Pat. Nos. 3,615,613, 3,615,641, 3,617,295 and 3,635,721 are especially useful.

Various compounds can be included in the photographic emulsions used in the invention with a view to preventing the occurrence of fogging during the manufacture, storage or photographic processing of the photosensitive material or with a view to stabilizing photographic performance. Thus many compounds which are known as anti-foggants or stabilizers, such as azoles, for example benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (especially 1-phenyl-5-mercaptotetrazole); thioketone compounds such as oxadorinthione; azaindenes, for example triazaindenes, tetraazaindenes (especially 4-hydroxy substituted (1,3,3*a*,7)tetraazaindenes), pentaazaindenes; benzenethiosulfonic acid, benzenesulfinic acid, and benzenesulfonic acid amide can be used of this purpose.

Among these compounds, the benzotriazoles (for example 5-methylbenzotriazole) and the nitroindazoles (for example 5-nitroindazole) are especially preferred. These compounds may also be included in processing baths.

Inorganic or organic hardening agents can be included in the photographic emulsion layers or other hydrophilic colloidal layers of photographic materials of this invention. For example, chromium salts (chrome alum), aldehydes (formaldehyde, glutaraldehyde), N-methylol compounds (dimethylolurea), active vinyl compounds (1,3,5-triacryloyl-hexabicyclo-s-triazine, 1,3-vinylsulfonyl-2-propanol), active halogen compounds (2,4-dichloro-6-hydroxy-s-triazine), and mucohalogenic acids (mucochloric acid}, can be used individually or in combination for this purpose.

Various surfactants can be included in the photographic emulsion layers or the hydrophilic colloid layers of the photosensitive materials prepared in accordance with the invention as coating promotors or for various purposes, such as the prevention of static, the improvement of slip properties, for emulsion and dispersion purposes, for the prevention of sticking, and for the improvement of photographic characteristics (for example, to accelerate development, to increase contrast and for sensitization purposes)

For example, use can be made of non-ionic surfactants, such as saponin (steroid based), alkylene oxide derivatives (for example, poly(ethylene glycol), poly(ethylene glycol)/poly(propylene glycol) condensates, poly(ethylene glycol) alkyl ethers or poly(ethylene glycol) alkyl aryl ethers, poly(ethylene glycol) esters, poly(ethylene glycol) alkylamines or amides, poly(ethylene oxide) adducts of silicones), glycidol derivatives (for example, alkenylsuccinic acid polyglyceride, alkylphenol polyglyceride), fatty acid esters of polyhydric alcohols, alkyl esters of sugars; anionic surfactants which contain an acidic group such as a carboxyl group, sulfo group, phosphono group, sulfate ester group, or phosphate ester group, such as alkylcarboxylic acid salts, alkylsulfonic acid salts, alkylbenzenesulfonic acid salts, alkylnaphthalenesulfonic acid salts, alkyl sulfate esters, alkyl phosphate esters, N-acyl-N-alkyltaurines, sulfosuccinic acid esters, sulfoalkyl polyoxyethylenealkylphenyl ethers, and polyoxyethylenealkyl phosphate esters; amphoteric surfactants such as amino acids, aminoalkylsulfonic acids, aminoalkyl sulfate or phosphate esters, alkylbetaines, and amine oxides, and cationic surfactants such as alkylamine salts, aliphatic or aromatic quaternary ammonium salts, heterocyclic quaternary ammonium salts, such as pyridinium or imidazolium salts, and phosphonium and sulfonium salts which contain aliphatic or heterocyclic components.

The use of the poly(alkylene oxides) of molecular weight at least 600 disclosed in JP-B-58-9412 is especially desirable in this invention.

Dispersions of water-insoluble or sparingly soluble synthetic polymers can be included in the photographic materials used in the invention with a view to improving the dimensional stability of the photographic emulsion layers and other hydrophilic colloid layers. For example, polymers of alkyl (meth)acrylates, alkoxyalkyl (meth)acrylates, glycidyl (meth)acrylates, (meth)acrylamides, vinyl esters (for example vinyl acetate), acrylonitrile, olefins, styrene, either individually or in combinations, or polymers in which combinations of these with acrylic acid, methacrylic acid, $\alpha,\beta$-unsaturated dicarboxylic acids, hydroxyalkyl (meth)acrylates, sulfoalkyl (meth)acrylates, or styrenesulfonic acid are used as the monomeric components can be used for this purpose The term "(meth)acrylate" used herein means "acrylate or methacrylate".

This invention is described in more detail below with reference to specific examples, but this invention is not to be construed as being limited thereto. Unless otherwise indicated, all parts percents and ratios are by weight.

EXAMPLE 1

An aqueous solution of silver nitrate and an aqueous solution of potassium bromide and potassium iodide were mixed using the double jet method in the presence of ammonia while maintaining the pAg value at 7.9, and the mono-disperse cubic silver iodobromide emulsion A of average grain size 0.2 microns (2 mol % silver iodide, 98 mol % silver bromide) was obtained. A mono-disperse, cubic, silver bromide emulsion B of average grain size 0.35 microns was prepared separately from the above mentioned emulsion A by mixing an aqueous solution of silver nitrate with an aqueous solution of potassium bromide using the double jet method in the presence of ammonia while maintaining the pAg value at 7.9. Emulsion A was sulfur sensitized using sodium thiosulfate.

Furthermore, emulsions A and B were spectrally sensitized by adding $6\times10^{-4}$ mol per mol of silver and $4.5\times10^{-4}$ mol per mol of silver of the sensitizing dye 5,5'-dicyclo-3,3'-di(3-sulfopropyl)-9-ethyl-oxacarbocyanine, sodium salt, to the emulsions A and B respectively.

Moreover, 4-hydroxy-6-methyl-1,3,3*a*,7-tetrazaindene was added as a stabilizer.

The emulsions A and B were mixed together in such proportions that the silver halide ratio by weight was 4:1, and then the compound indicated below and an aqueous dispersion of poly(ethyl acrylate) were added so as to provide coated weights of 0.40 g/m$^2$ and 0.40 gram of solid fraction per square meter respectively.

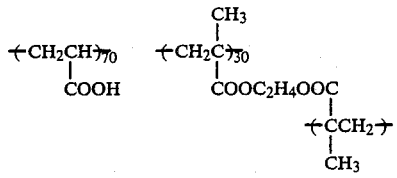

Moreover, $4\times10^{-3}$ mol per mol of silver of the hydrazine derivative H-9, and 1,4-bis(3-(4-acetylaminopyridino) propionyloxy)tetramethylene dibromide were added.

Moreover, alkylbenzenesulfonate was added as surfactant and 1,3-divinylsulfonyl-2-propanol (sic) was added as a film hardening agent and, after adjusting the pH of the emulsion prepared in this way to 5.8, it was coated onto a poly(ethylene terephthalate) support of thickness 100 microns such that the weight of coated silver was 3.0 g/m$^2$. Gelatin was then coated over the emulsion layer at the rate of 1.5 g/m$^2$ as a protective layer. This was film No. 1.

Film No. 1 was exposed for 5 seconds through an optical wedge used for sensitometric purposes using tungsten light of 3,200° K and then it was processed for 30 seconds at 38° C. in the development baths of which the compositions are indicated below, fixed, washed and dried. (A Fuji Photo Film Co., Ltd. Automatic Developing Machine FG-660F was used for the development processing.)

The samples obtain were subjected to density measurement using a Macbeth densitometer and the photographic characteristics were investigated.

TABLE 1

| | | Developer Solution | | | | | | |
|---|---|---|---|---|---|---|---|---|
| | | A | B | C | D | E | F | G |
| Ethylenediamine tetra-acetic acid, sodium salt | (g) | 1.0 | 1.0 | 1.0 | 1.0 | 1.0 | 1.0 | 1.0 |
| Sodium hydroxide | (g) | 9.0 | 9.0 | 9.0 | 9.0 | 9.0 | 9.0 | 9.0 |
| Potassium triphosphate | (g) | 74.0 | 74.0 | 74.0 | 74.0 | 74.0 | 74.0 | 74.0 |
| Sodium sulfite | (g) | 75.0 | 75.0 | 75.0 | 75.0 | 75.0 | 75.0 | 75.0 |
| 5-Methylbenzotriazole | (g) | 0.5 | 0.5 | 0.5 | 0.5 | 0.5 | 0.5 | 0.5 |
| Sodium bromide | (g) | 3.0 | 3.0 | 3.0 | 3.0 | 3.0 | 3.0 | 3.0 |
| 4-Methyl-4-hydroxymethyl-1-phenyl-3-pyrazolidone | (g) | 0.2 | 0.2 | 0.2 | 0.2 | 0.2 | 0.2 | 0.2 |
| Hydroquinone | (g) | 35.0 | 35.0 | 35.0 | 35.0 | 35.0 | 35.0 | 35.0 |
| n-Butyldiethanolamine | (g) | 12.0 | 12.0 | 12.0 | 15.0 | 12.0 | 12.0 | 12.0 |
| Sodium p-toluenesulfonato | (g) | 14.0 | 14.0 | 14.0 | 14.0 | 14.0 | 14.0 | 14.0 |
| Compound 10 of this invention | (mg) | — | 250 | — | — | — | — | — |
| Compound 13 of this invention | (mg) | — | — | 317 | — | — | — | — |
| Compound 46 of this invention | (mg) | — | — | — | — | 201 | — | — |
| Compound 54 of this invention | (mg) | — | — | — | — | — | 358 | — |
| Compound 63 of this invention | (mg) | — | — | — | — | — | — | 317 |
| Water, to make up to | | 1 l | 1 l | 1 l | 1 l | 1 l | 1 l | 1 l |
| pH (Potassium hydroxide added) | 11.7 | 11.7 | 11.7 | 11.7 | 11.7 | 11.7 | 11.7 | 11.7 |

Moreover, running tests were carried out by processing 200 sheets of film on which three quarters of the whole area (50.8 cm×61.0 cm) of film No. 1 had been fully exposed per day for 5 days in the development baths shown in Table 1, while replenishing each development bath at the rate of 75 ml per sheet of film.

The results obtained were as shown in Table 2. The sensitivities are shown as relative values, taking the reciprocal of the exposure required to provide a density of 1.5 on processing in development bath A as 100. Black spotting (black pepper) was evaluated in five grades by microscopic observation, a score of "5" indicating the best quality and a score of "1" indicating the worst quality. Scores of "5" or "4" indicate that the material is suitable for practical use, a score of "3" is on the limit for practical use and scores of "2" or "1" indicate that the material is of no practical use. Results between "5" and "4", and between "4" and "3", were evaluated as scores of "4.5" and "3.5" respectively.

Furthermore, the photographic performance in terms of sensitivities after the running test is shown by means of relative values, taking the reciprocal of the exposure required to provide a density of 1.5 on processing after the running tests in development bath A to be 100.

TABLE 2

| Test No. | Developer Solution | Sensitivity | $D_{max}$ | Black Spotting (Black Pepper) | Photographic Performance After Running Test: Sensitivity | Photographic Performance After Running Test: $D_{max}$ |
|---|---|---|---|---|---|---|
| 1 | A (Comparison) | 100 | 4.5 | 4.5 | 100 | 3.4 |
| 2 | B (This invention) | 100 | 5.2 | 4.5 | 100 | 4.7 |
| 3 | C (This invention) | 100 | 5.0 | 4.5 | 100 | 4.5 |
| 4 | D (Comparison) | 120 | 5.0 | 2 | 120 | 4.3 |
| 5 | E (This Invention) | 95 | 5.3 | 5 | 95 | 5.0 |
| 6 | F (This Invention) | 100 | 5.1 | 4.5 | 100 | 4.8 |
| 7 | G (This Invention) | 100 | 5.0 | 4.5 | 100 | 4.6 |

As is clear from the results in Table 2, when the developer solutions according to this invention (B, C E, F and G) were used, a higher $D_{max}$ value and little black spotting were obtained. In the case where the comparative developer solution A was used, the value of $D_{max}$ was low although a good black spotting was obtained. In the case using the comparative developer solutiOn D, although the value of $D_{max}$ was high, the black spotting was poor, and the material was not suitable for practical use. Moreover, the change of the $D_{max}$ value upon running processing could be made smaller by using the developer solutions of this invention.

EXAMPLE 2

Anhydro-5,5-dichloro-9-ethyl-3,3-bis(3-sulfopropyl) oxacarbocyanine hydroxide, sodium salt, (230 mg per mol of silver, sensitizing dye), and $4\times10^{-3}$ mol per mol of silver of the hydrazine derivative H-9 and 300 mg per mol of silver of poly(ethylene glycol) (molecular weight about 1,000) were added to a 0.3 μm cubic silver iodobromide emulsion which contained 2.5 mol % of iodide, and then 5-methylbenztriazole, 4-hydroxy-6-methyl-1,3,3*a*,7-tetrazaindene, a dispersion of poly(ethyl acrylate) and bis(vinylsulfonylmethyl) ether were added.

The coating composition prepared in this way was coated onto a poly(ethylene terephthalate) film support to provide a coated silver weight of 4.0 g/m$^2$, and a gelatin coated weight of 2.5 g/m$^2$, and a film was obtained in this way. Moreover, gelatin was coated over this layer at the rate of 1 g/m$^2$ as a protective layer to provide film No. 2.

The film No. 2 was exposed through an exposing wedge for sensitometric purposes and then it was developed for 30 seconds at 38° C. in the development baths used in Example 1, fixed, washed and dried. (A Fuji Photo Film Co., Ltd. Automatic Developing Machine FG 660F was used for the development processing.) The results obtained are shown in Table 3.

TABLE 3

| Test No. | Developer Solution | Sensitivity | $D_{max}$ | Black Spotting (Black Pepper) | Photographic Performance After Running Test: Sensitivity | Photographic Performance After Running Test: $D_{max}$ |
|---|---|---|---|---|---|---|
| 1 | A (Comparison) | 100 | 4.2 | 4.5 | 100 | 3.3 |
| 2 | B (This Invention) | 100 | 4.8 | 4.5 | 100 | 4.3 |
| 3 | C (This Invention) | 100 | 4.8 | 4.5 | 100 | 4.3 |
| 4 | D (Comparison) | 120 | 4.8 | 2 | 120 | 4.0 |
| 5 | E (This Invention) | 95 | 5.0 | 5 | 95 | 4.5 |
| 6 | F (This Invention) | 100 | 4.9 | 4.5 | 100 | 4.4 |
| 7 | G (This Invention) | 100 | 4.8 | 4.5 | 100 | 4.3 |

The sensitivities with normal processing and after the running tests are shown as relative values taking the reciprocal of the exposure required to obtain a density of 1.5 on processing in developer solution A to be 100. Black spotting (black pepper) was evaluated in the same way as in Example 1.

It is clear from the results shown in Table 3 that a high $D_{max}$ and little black spotting (black pepper) were obtained on processing in developer solutionS B, C, E, F and G of this invention. The result for black spotting was good with comparative developer solution A, but the Value for $D_{max}$ was low. Moreover, the value for $D_{max}$ was high on processing in comparative developer solution D but the result for black spotting (black pepper) was poor and the combination could not be used in practice. Furthermore, the change in $D_{max}$ after the running test was clearly reduced by the developer solutions of this invention.

EXAMPLE 3

The tests conducted in Example 1 were repeated except that the film Nos. 1 and 2 used in Examples 1 and 2 were developed for 30 seconds at 34° C. in developer solutions as shown in Table 4. The results obtained are as shown in Table 5. The sensitivities are shown as relative values in which the reciprocal of the exposure required to provide a density of 1.5 on processing in the developer solution H with normal processing or after the running test with film No. 1 or film No. 2 was taken to be 100. Black spotting (black pepper) was evaluated in the same way as in Example 1.

TABLE 4

| | | Developer Solution | | | | | | |
|---|---|---|---|---|---|---|---|---|
| | | H | I | J | K | L | M | N |
| Ethylenediamine tetra-acetic acid, sodium salt | (g) | 1.0 | 1.0 | 1.0 | 1.0 | 1.0 | 1.0 | 1.0 |
| Sodium hydroxide | (g) | 9.0 | 9.0 | 9.0 | 9.0 | 9.0 | 9.0 | 9.0 |
| 5-Sulfosalicylic acid | (g) | 70.0 | 70.0 | 70.0 | 70.0 | 70.0 | 70.0 | 70.0 |
| Potassium sulfite | (g) | 110.0 | 110.0 | 110.0 | 110.0 | 110.0 | 110.0 | 110.0 |
| 5-Methylbenzotriazole | (g) | 0.35 | 0.35 | 0.35 | 0.35 | 0.35 | 0.35 | 0.35 |
| Potassium bromide | (g) | 5.0 | 5.0 | 5.0 | 5.0 | 5.0 | 5.0 | 5.0 |
| N-Methyl-p-aminophenol, $\frac{1}{2}H_2SO_4$ | (g) | 1.0 | 1.0 | 1.0 | 1.0 | 1.0 | 1.0 | 1.0 |
| Hydroquinone | (g) | 44.0 | 44.0 | 44.0 | 44.0 | 44.0 | 44.0 | 44.0 |
| n-Butyldiethanolamine | (g) | 16.0 | 16.0 | 16.0 | 19.0 | 16.0 | 16.0 | 16.0 |
| Boric acid | (g) | 5.0 | 5.0 | 5.0 | 5.0 | 5.0 | 5.0 | 5.0 |
| Sodium p-toluenesulfonate | (g) | 14.0 | 14.0 | 14.0 | 14.0 | 14.0 | 14.0 | 14.0 |
| Compound 10 of this invention | (mg) | — | 250 | — | — | — | — | — |
| Compound 13 of this invention | (mg) | — | — | 317 | — | — | — | — |
| Compound 46 of this invention | (mg) | — | — | — | — | 201 | — | — |
| Compound 54 of this invention | (mg) | — | — | — | — | — | 358 | — |
| Compound 63 of this invention | (mg) | — | — | — | — | — | — | 317 |
| Water, to make up to | (l) | 1 | 1 | 1 | 1 | 1 | 1 | 1 |
| pH (Potassium hydroxide added) | 11.7 | 11.7 | 11.7 | 11.7 | 11.7 | 11.7 | 11.7 | 11.7 |

TABLE 5

| Test No. | Developer Solution | Film No. | Sensitivity | $D_{max}$ | Black Spotting (Black Pepper) | Photographic Performance After Running Test: Sensitivity | Photographic Performance After Running Test: $D_{max}$ |
|---|---|---|---|---|---|---|---|
| 1 | H (Comparison) | 1 | 100 | 4.7 | 4.5 | 100 | 3.4 |
| 2 | I (This Invention) | 1 | 100 | 5.3 | 4.5 | 100 | 4.6 |
| 3 | J (This Invention) | 1 | 100 | 5.1 | 4.5 | 100 | 4.5 |
| 4 | K (Comparison) | 1 | 120 | 5.1 | 2 | 120 | 4.3 |
| 5 | L (This Invention) | 1 | 95 | 5.5 | 5 | 95 | 5.1 |
| 6 | M (This Invention) | 1 | 100 | 5.2 | 4.5 | 100 | 4.8 |
| 7 | M (This Invention) | 1 | 100 | 5.2 | 4.5 | 100 | 4.8 |
| 8 | H (Comparison) | 2 | 100 | 4.4 | 4 | 100 | 3.3 |
| 9 | I (This Invention) | 2 | 100 | 4.8 | 4 | 100 | 4.3 |
| 10 | J (This Invention) | 2 | 100 | 4.8 | 4 | 100 | 4.3 |
| 11 | K (Comparison) | 2 | 120 | 4.8 | 1.5 | 120 | 4.0 |
| 12 | L (This Invention) | 2 | 95 | 5.1 | 4.5 | 95 | 4.5 |
| 13 | M (This Invention) | 2 | 100 | 5.0 | 4.5 | 100 | 4.4 |
| 14 | N (This Invention) | 2 | 100 | 4.9 | 4 | 100 | 4.3 |

It is clear from the results shown in Table 5 that $D_{max}$ was high and there was little black spotting (black pepper) on processing both film No. 1 and film No. 2 in the developer solutions I, J, L, M and N of this invention. The results obtained on processing in comparative developer solution H were good for black spotting (black pepper) but $D_{max}$ was low. Moreover, the results obtained on processing in comparative developer solution K showed a high $D_{max}$, but the results for black spotting (black pepper) were poor and the combination could not be used in practice. Furthermore, the change in $D_{max}$ after the running tests was also clearly reduced by the developer solutions of this invention.

EXAMPLE 4

A cubic, mono-disperse emulsion which contained, on average, 0.4 mol % of silver iodide of average grain size 0.28 μm was prepared by adding an aqueous solution of silver nitrate and an aqueous solution of silver iodide and silver bromide simultaneously over a period of 60 minutes in the presence of $4\times10^{-7}$ mol per mol of silver of potassium hexachloroiridate (III) and ammonia to an aqueous gelatin solution which was being maintained at 50° C. This emulsion was de-salted using the flocculation method, 40 grams of inactive gelatin was added per mol of silver and, while maintaining at 50° C., $3\times10^{-4}$ mol per mol of silver of 5,5'-dichloro-9-ethyl-3,3'-bis(3-sulfopropyl)oxacarbocyanine was added as a sensitizing dye and 0.1 mol per mol of silver of KI solution was added. The mixture obtained was formed into a solution by maintaining it at 50° C. for 15 minutes and then 0.052 mol per mol of silver of hydroquinone and $2\times10^{-4}$ mol per mol of silver of the compound (a) of which the formula is indicated below, $1.2\times10^{-3}$ mol per mol of silver of the hydrazine compound H-9 and $0.5\times10^{-4}$ mol per mol of silver of the hydrazine derivative H-35 were added.

(a)

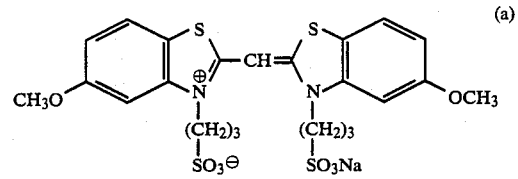

Moreover, 5-methylbenztriazole, 4-hydroxy-1,3,3a,7-tetrazaindene, the compounds (b) and (c) indicated below and a dispersion of poly(ethyl acrylate) and 1,3-divinylsulfonyl-2-propanol were added and the mixture was coated to provide a coated silver weight of 3.4 g/m² on a poly(ethylene terephthalate) film.

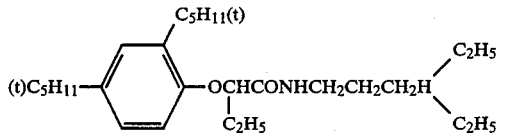

(b)

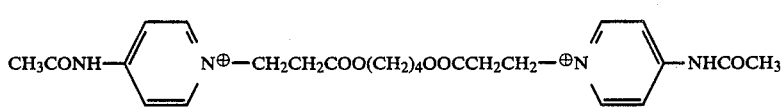

(c)

A layer containing 1.5 g/m$^2$ of gelatin, 50 mg/m$^2$ of poly(methylmethacrylate) of particle size 2.5 μm, 0.15 g/m$^2$ of methanol silica, particle size, and the fluorine based surfactant of which the structural formula is indicated below as coating promoter, and sodium dodecylbenzenesulfonate, was coated at the same time over the aforementioned layer as a protective layer to provide film No. 3.

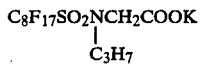

This film No. 3 was processed and evaluated in the same way as in Example 1 using the develop solutions indicated in Tables 1 and 4. The results obtained are shown in Table 6.

TABLE 6

| Test No. | Developer Solution | Sensitivity | $D_{max}$ | Black Spotting (Black Pepper) | Photographic Performance After Running Test: Sensitivity | Photographic Performance After Running Test: $D_{max}$ |
|---|---|---|---|---|---|---|
| 1 | A (Comparison) | 100 | 4.4 | 4.5 | 100 | 3.3 |
| 2 | B (This Invention) | 100 | 4.9 | 4.5 | 100 | 4.2 |
| 3 | C (This Invention) | 100 | 4.8 | 4.5 | 100 | 4.2 |
| 4 | D (Comparison) | 120 | 4.9 | 2.0 | 120 | 4.3 |
| 5 | E (This Invention) | 95 | 5.0 | 5.0 | 95 | 4.5 |
| 6 | F (This Invention) | 100 | 4.8 | 4.0 | 100 | 4.2 |
| 7 | G (This Invention) | 100 | 4.8 | 4.5 | 100 | 4.2 |
| 8 | H (Comparison) | 100 | 4.7 | 4.0 | 100 | 4.4 |
| 9 | I (This Invention) | 100 | 5.1 | 4.5 | 100 | 4.4 |
| 10 | J (This Invention) | 100 | 5.1 | 4.5 | 100 | 4.3 |
| 11 | K (Comparison) | 120 | 5.1 | 2.0 | 120 | 4.4 |
| 12 | L (This Invention) | 95 | 5.3 | 5.0 | 95 | 4.6 |
| 13 | M (This Invention) | 100 | 5.2 | 4.5 | 100 | 4.3 |
| 14 | N (This Invention) | 100 | 5.2 | 4.0 | 100 | 4.3 |

It is clear from the results shown in Table 6 that on processing in developer solutions B, C, E, F, G, I, J, L, M and N which are examples of the invention, the value of $D_{max}$ was high and there was little black spotting (black pepper). The results obtained on processing in comparative developer solutions A and H were good for black spotting (black pepper) but $D_{max}$ was low. Moreover, the results obtained on processing in comparative developer solutions D and K showed a high $D_{max}$ but the results for black spotting (black pepper) were poor and the combinations could not be used in practice. Furthermore, the change in $D_{max}$ after the running tests was also clearly reduced by the developer solutions of this invention.

While the invention has been described in detail and with reference to specific embodiments thereof, it will be apparent to one skilled in the art that various changes and modifications can be made therein without departing from the spirit and scope thereof.

What is claimed is:

1. A method for forming a high contrast negative image comprising the steps of:

(a) imagewise exposing a silver halide photographic material comprising a support having thereon at least one light sensitive silver halide emulsion layer, said emulsion layer or other hydrophilic colloid layer containing at least one hydrazine derivative; and (b) developing said exposed silver halide photographic material in a developer solution containing:

(1) a dihydroxybenzene developing agent;

(2) at least one auxiliary developing agent selected from a 1-phenyl-3-pyrazolidone auxiliary developing agent and a p-aminophenol auxiliary developing agent;

(3) at least 0.3 mol per liter of a sulfite; and (4) at least one compound represented by formula (I):

$$Y\left(\left(A\right)_n B\right)_m \quad \text{(I)}$$

wherein Y represents a group capable of adsorbing to silver halide; A represents a divalent linking group; B represents an amino group, an ammonium group or a nitrogen containing heterocyclic group; m is 1, 2 or 3; and n is 0 or 1; to form a high contrast negative image.

2. A method for forming a high contrast negative image as claimed in claim 1, wherein said group capable of adsorbing to silver halide represented by Y is selected from a substituted or unsubstituted thioamido group, a substituted or unsubstituted mercapto group, a substituted or unsubstituted group containing a disulfide bond, and a substituted or unsubstituted 5-membered or 6-membered nitogen-containing hetrocyclic group.

3. A method for forming a high contrast negative image as claimed in claim 1, wherein said divalent linking group represented by A is selected from an alikylene group, an alkenylene group, an alkynylene group, an arylene group, —O—, —S—, —NH—, —N=, —CO—, $SO_2$— and combinations thereof.

4. A method for forming a high contrast negative image as claimed in claim 1, wherein said amino group represented by B is represented by formula (II):

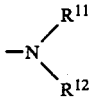

(II)

wherein $R^{11}$ and $R^{12}$, which may be the same or different, each represents a hydrogen atom, a substituted or unsubstituted alkyl group, a substituted or unsubstituted alkenyl group or a substituted or unsubstituted aralkyl group; or $R^{11}$ and $R^{12}$ are linked to form a saturated heterocyclic ring containing at least one hetero atom selected from oxygen, sulfur and nitrogen.

5. A method for forming a high contrast negative image as claimed in claim 1, wherein said amino group represented by B is represented by formula (III):

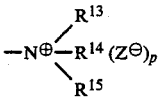

(III)

wherein $R^{13}$, $R^{14}$ and $R^{15}$, which may be the same or different, each represents a hydrogen atom, a substituted or unsubstituted alkyl group, a substituted or unsubstituted alkenyl group or a substituted or unsubstituted aralkyl group; $Z^{\ominus}$ represents an anion necessary for charge balance; and p is 0 or 1.

6. A method for forming a high contrast negative image as claimed in claim 1, wherein said nitrogen-containing heterocyclic group represented by B is selected from an imidazolyl group, a pyridyl group and a thiazolyl group.

7. A method for forming a high contrast negative image as claimed in claim 1, wherein said compound represented by formula (I) is represented by formula (IV):

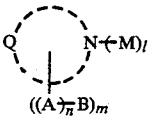

(IV)

wherein A, B, m and n each is defined as in formula (I); Q represents an atomic group necessary for forming a 5-membered or 6-membered heterocyclic ring containing atoms selected from carbon, nitrogen, oxygen and sulfur, said 5-membered or 6-membered hetrocyclic ring may be condensed with a carbon aromatic ring or a hetrocyclic aromatic ring; l is 0 or 1; and M represents a hydrogen atom, an alkali metal, an ammonium group or a group capable of being replaced by a hydrogen atom or an alkali metal under alkaline conditions.

8. A method for forming a high contrast negative image as claimed in claim 1, wherein said compound represented by formula (I) is represented by formula (V):

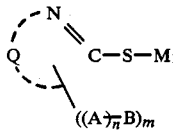

(V)

wherein A, B, m and n each is defined as in formula (I); Q represents an atomic group necessary for forming a 5-membered or 6-membered heterocyclic ring containing atoms selected from carbon, nitrogen, oxygen and sulfur, said 5-membered or 6-membered hetrocyclic ring may be condensed with a carbon aromatic ring or a hetrocyclic aromatic ring; and M represents a hydrogen atom, an alkali metal, an ammonium group or a group capable of being replaced by a hydrogen atom or a alkali metal under alkaline conditions.

9. A method for forming a high contrast negative image as claimed in claim 1, wherein said compound represented by formula (I) is represented by formula (VI), (VII), (VIII), (IX), (X) or (XI):

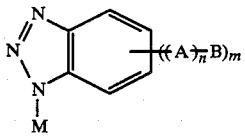

(VI)

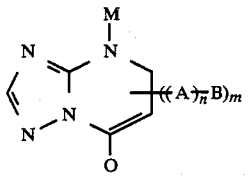

(VII)

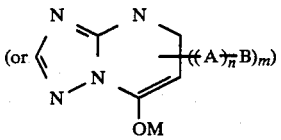

(VIII)

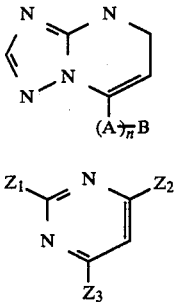

(IX)

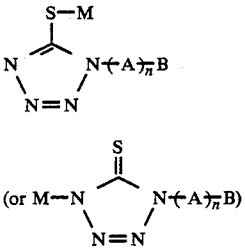

(X)

-continued (XI)

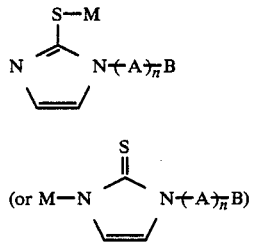

wherein A, B, m and n each is defined as in formula (I); M represents a hydrogen atom, an alkali metal, atom an ammonium group or a group capable of being replaced by a hydrogen atom or a alkali metal atom under alkaline conditions; and $Z_1$, $Z_2$ and $Z_3$, which may be the same or different, each represents $$(\text{A})_n\text{B})_m$$

as defined in claim 1, a halogen atom, an alkoxy group having not more than 20 carbon atoms, a hydroxyl group, a hydroxyamono group or a substituted or unsubstituted amono group, provided that at least one of $Z_1$, $Z_2$ and $Z_3$ represents a group $$(\text{A})_n\text{B})_m$$

as defined in claim 1.

10. A method for forming a high contrast negative image as claimed in claim 1, wherein said hydrazine derivative contained in said silver halide photographic material is represented by formula (XII):

$$R_1\text{—NHNH—CHO} \qquad \text{(XII)}$$

wherein $R_1$ represents an aliphatic group or an aromatic group.

11. A method for forming a high contrast negative image as claimed in claim 10, wherein $R_1$ represents an alkyl group having from 1 to 30 cabon atoms, a single or double ring aryl group or an aromatic unsaturated heterocyclic group.

12. A method for forming a high contrast negative image as claimed in claim 11, wherein $R_1$ represents an aryl group.

13. A method for forming a high contrast negative image as claimed in claim 1, wherein said hydrazine derivative is contained in said light-sensitive silver halide emulsion layer.

14. A method for forming a high contrast negative image as claimed in claim 1, wherein said dihydroxybenzene developing agent is hydroquinone.

15. A method for forming a high contrast negative image as claimed in claim 14, wherein said auxiliary developing agent is N-methyl p-aminophenol.

16. A method for forming a high contrast negative image as claimed in claim 1, wherein said developer solution contains from $1\times10^{-2}$ to $1\times10^{-5}$ mol per liter of said compound represented by formula (I); from 0.05 to 0.8 mol per liter of said dihydroxybenzene developing agent; from 0.05 to 0.5 mol per liter of said 1-phenyl-3-pyrazolidone auxiliary developing agent; at most 0.06 mol per liter of said p-aminophenol auxiliary developing agent; and at most 1.2 mol per liter of said sulfite.

17. A method for forming a high contrast negative image as claimed in claim 1, wherein said developer solution has a pH of 9 or more.

18. A method for forming a high contrast negative image as claimed in claim 17, wherein said developer solution has a pH of from 9.5 to 12.3.

19. A method for forming a high contrast negative image as claimed in claim 10, wherein said silver halide photographic material contains from $1\times10^{-6}$ to $1\times10^{-1}$ mol of said hydrazine derivative per mol of said silver halide.

20. A method for forming a high contrast negative image as claimed in claim 1, wherein the average gamma value within the density range of from 0.3 to 3.0 of said high contrast negative image is from 8.0 to 30.0.

21. A method for forming a high contrast negative image as claimed in claim 20, wherein the average gamma value within the density range of from 0.3 to 3.0 of said high contrast negative image is from 10.0 to 25.0.

* * * * *